US009609410B2

(12) United States Patent
Miluzzi et al.

(10) Patent No.: US 9,609,410 B2
(45) Date of Patent: Mar. 28, 2017

(54) PROCESSING CIRCUIT FOR A MULTIPLE SENSING STRUCTURE DIGITAL MICROELECTROMECHANICAL SENSOR HAVING A BROAD DYNAMIC RANGE AND SENSOR COMPRISING THE PROCESSING CIRCUIT

(71) Applicant: STMICROELECTRONICS S.R.L., Agrate Brianza (IT)

(72) Inventors: Eugenio Miluzzi, Milan (IT); Martino Zerbini, Abbiategrasso (IT); Davide Negri, Pavia (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 43 days.

(21) Appl. No.: 14/626,636

(22) Filed: Feb. 19, 2015

(65) Prior Publication Data

US 2015/0237432 A1 Aug. 20, 2015

(30) Foreign Application Priority Data

Feb. 20, 2014 (IT) ..... TO2014A0140

(51) Int. Cl.

*H04R 3/00* (2006.01)
*H04R 1/08* (2006.01)
*H04R 1/04* (2006.01)

(52) U.S. Cl.

CPC ..... *H04R 1/08* (2013.01); *H04R 1/04* (2013.01); *H04R 3/00* (2013.01); *H04R 2201/003* (2013.01)

(58) Field of Classification Search

CPC ..... H04R 1/08; H04R 2201/003; H04R 3/00; H04R 1/04
USPC ..... 381/91–92, 122, 111, 120
See application file for complete search history.

(56) References Cited

U.S. PATENT DOCUMENTS

| | | | |
|---|---|---|---|
| 6,271,780 | B1 | 8/2001 | Gong et al. |
| 7,359,504 | B1 | 4/2008 | Reuss et al. |
| 8,223,981 | B2 | 7/2012 | Haila et al. |
| 2004/0252855 | A1 | 12/2004 | Vasserman et al. |

(Continued)

FOREIGN PATENT DOCUMENTS

| | | | |
|---|---|---|---|
| EP | 1 962 546 | A2 | 8/2008 |
| JP | 62-213400 | A | 9/1987 |

(Continued)

OTHER PUBLICATIONS

Office Action dated Sep. 2, 2014, for corresponding Japanese Application No. 2011-002313, with partial English Translation, 5 pages.

*Primary Examiner* — Disler Paul
(74) *Attorney, Agent, or Firm* — Seed Intellectual Property Law Group LLP

(57) ABSTRACT

A processing circuit for a digital sensor, including: a control stage, which generates a control signal; a multiplexing stage, which may be electrically coupled to a plurality of sensing structures for receiving corresponding detection signals and generates a multiplexed signal, on the basis of one between the detection signals, as a function of the control signal; an analog-to-digital conversion stage, which is connected to the multiplexing stage and generates an encoded signal on the basis of the multiplexed signal; and an equalizer, which multiplies the encoded signal by a coefficient that depends upon the control signal.

18 Claims, 8 Drawing Sheets

(56) References Cited

U.S. PATENT DOCUMENTS

| | | | | |
|---|---|---|---|---|
| 2008/0133224 | A1* | 6/2008 | Kong | H03H 17/0279 704/201 |
| 2009/0316916 | A1 | 12/2009 | Haila et al. | |
| 2010/0284553 | A1 | 11/2010 | Conti et al. | |
| 2010/0310096 | A1* | 12/2010 | Josefsson | H04R 3/06 381/113 |
| 2011/0029109 | A1 | 2/2011 | Thomsen et al. | |
| 2012/0093333 | A1 | 4/2012 | Hu et al. | |
| 2014/0010374 | A1 | 1/2014 | Kasai et al. | |
| 2014/0133677 | A1 | 5/2014 | Zerbini et al. | |
| 2014/0140538 | A1* | 5/2014 | Kropfitsch | H03G 3/002 381/106 |
| 2014/0254837 | A1* | 9/2014 | Mortensen | H03F 3/187 381/120 |

FOREIGN PATENT DOCUMENTS

| | | | |
|---|---|---|---|
| JP | 10-126886 | A | 5/1998 |
| JP | 2011-4129 | A | 1/2011 |
| WO | 2012/093598 | A1 | 7/2012 |

* cited by examiner

PROCESSING CIRCUIT FOR A MULTIPLE SENSING STRUCTURE DIGITAL MICROELECTROMECHANICAL SENSOR HAVING A BROAD DYNAMIC RANGE AND SENSOR COMPRISING THE PROCESSING CIRCUIT

BACKGROUND

Technical Field

The present disclosure relates to a processing circuit for a digital microelectromechanical sensor, which includes two or more sensing structures and has a broad dynamic range. In addition, the present disclosure relates to a sensor that includes the aforementioned processing circuit.

Description of the Related Art

As is known, there are today available acoustic transducers such as, for example, the so-called MEMS (microelectromechanical systems) microphones, each of which comprises a sensing structure of a MEMS type, which is also known as "detection structure" and is designed to transduce acoustic pressure waves into an electrical quantity (for example, a capacitive variation), and a reading electronics, designed to carry out appropriate operations of processing of this electrical quantity, for supplying an electrical output signal, whether analog (for example, a voltage) or digital; in the latter case, the microphone is a digital microphone. For instance, with particular reference to electrical output signals of a digital type, MEMS microphones are known that supply signals of a so-called "PDM" (pulse-density modulation) type.

The electrical output signal is then made available, possibly after prior further processing by an electronic interface circuit, to an external electronic system, such as for example a microcontroller of an electronic apparatus that incorporates the MEMS microphone.

In the case of MEMS acoustic transducers of a capacitive type, each sensing structure comprises a fixed electrode and a mobile electrode, which is formed by a diaphragm or membrane and is arranged facing the fixed electrode, so that the fixed electrode and the mobile electrode form the plates of a sensing capacitor with variable capacitance. The sensing capacitor is typically connected to a charge pump, which performs the task of maintaining the charge present on the sensing capacitor itself constant.

More in particular, a perimetral portion of the mobile electrode is typically anchored to a substrate, whereas a central portion of the mobile electrode is free to move following upon incidence of an acoustic signal, i.e., a pressure wave. Consequently, at least a part of the mobile electrode is arranged in oscillation by the acoustic signal, with consequent variation of the capacitance of the sensing capacitor.

An example of a sensing structure of a MEMS microphone of a capacitive type is described in US Patent Publication No. 2010/0284553 filed in the name of the present applicant.

In general, the electrical performance of a MEMS microphone depends upon the mechanical characteristics of the sensing structure, and further upon the configuration of the acoustic chambers formed by the sensing structure; in this connection, the sensing structure forms a front chamber and a rear chamber, which face, respectively, the front face and the rear face (opposite to one another) of the mobile electrode and are traversed, in use, by the pressure waves that impinge upon the sensing structure.

From a more quantitative standpoint, it is possible to characterize a sensing structure in terms of sensitivity and dynamics, the latter quantity being also known as "dynamic range".

The dynamic range indicates the sound-pressure levels (SPL) of the acoustic signals that may be correctly demodulated by the sensing structure. Consequently, the upper bound of the dynamic range indicates the sound-pressure level beyond which a saturation of the response of the sensing structure occurs, whereas the lower bound indicates the noise level, i.e., the sound-pressure level below which the acoustic signal is not detected.

The sensitivity is instead proportional to the ratio between the variation of the aforementioned electrical quantity (for example, the capacitance of the sensing capacitor) and the corresponding variation of the sound-pressure level.

This having been said, there are numerous applications in which there are used both a broad dynamic range, i.e., the possibility of detecting acoustic signals that have sound-pressure levels markedly different from one another, and a high sensitivity. Unfortunately, however, typically the sensing structures that have a high sensitivity are characterized also by narrow dynamic ranges, and vice versa. In addition, typically the sensing structures that have broad dynamic ranges are characterized by not particularly high signal-to-noise ratios (SNRs).

In this connection, U.S. Pat. No. 6,271,780 describes a solution for increasing the dynamic range, which envisages subjecting an analog input signal to two processing paths, each of which comprises a first, analog, portion and a second, digital, portion; further, each processing path is characterized by its own gain. The digital signals at output from the two processing paths are recombined to supply a resulting output signal. Before the two digital signals are recombined, they are subjected to operations of equalization for compensating for the differences present between the two processing paths, but for the different gains, in order to limit the distortions present on the resulting output signal.

The solution proposed in U.S. Pat. No. 6,271,780 is not free from problems, linked principally to the complexity of the processing chain, and thus to the dimensions of the area used for implementing this solution. In addition, this solution envisages that, starting from a single input signal, two intermediate signals are generated, which are then mixed to form an output signal.

BRIEF SUMMARY

One embodiment of the present disclosure is directed to a processing circuit for a digital sensor, that includes a control stage configured to generate a control signal, a multiplexing stage electrically coupled to a plurality of external signal sensing structures and configured to receive respective detection signals from said sensing structures, said multiplexing stage being configured to generate a multiplexed signal, on the basis of one of said detection signals, as a function of the control signal, an analog-to-digital conversion stage, coupled to the multiplexing stage and configured to generate a first encoded signal, on the basis of the multiplexed signal, and an equalizer, configured to multiply the first encoded signal by a coefficient that depends upon the control signal.

BRIEF DESCRIPTION OF THE SEVERAL VIEWS OF THE DRAWINGS

For a better understanding of the present disclosure, preferred embodiments thereof are now described, purely by way of non-limiting example and with reference to the annexed drawings, wherein.

DETAILED DESCRIPTION

Figure 1:
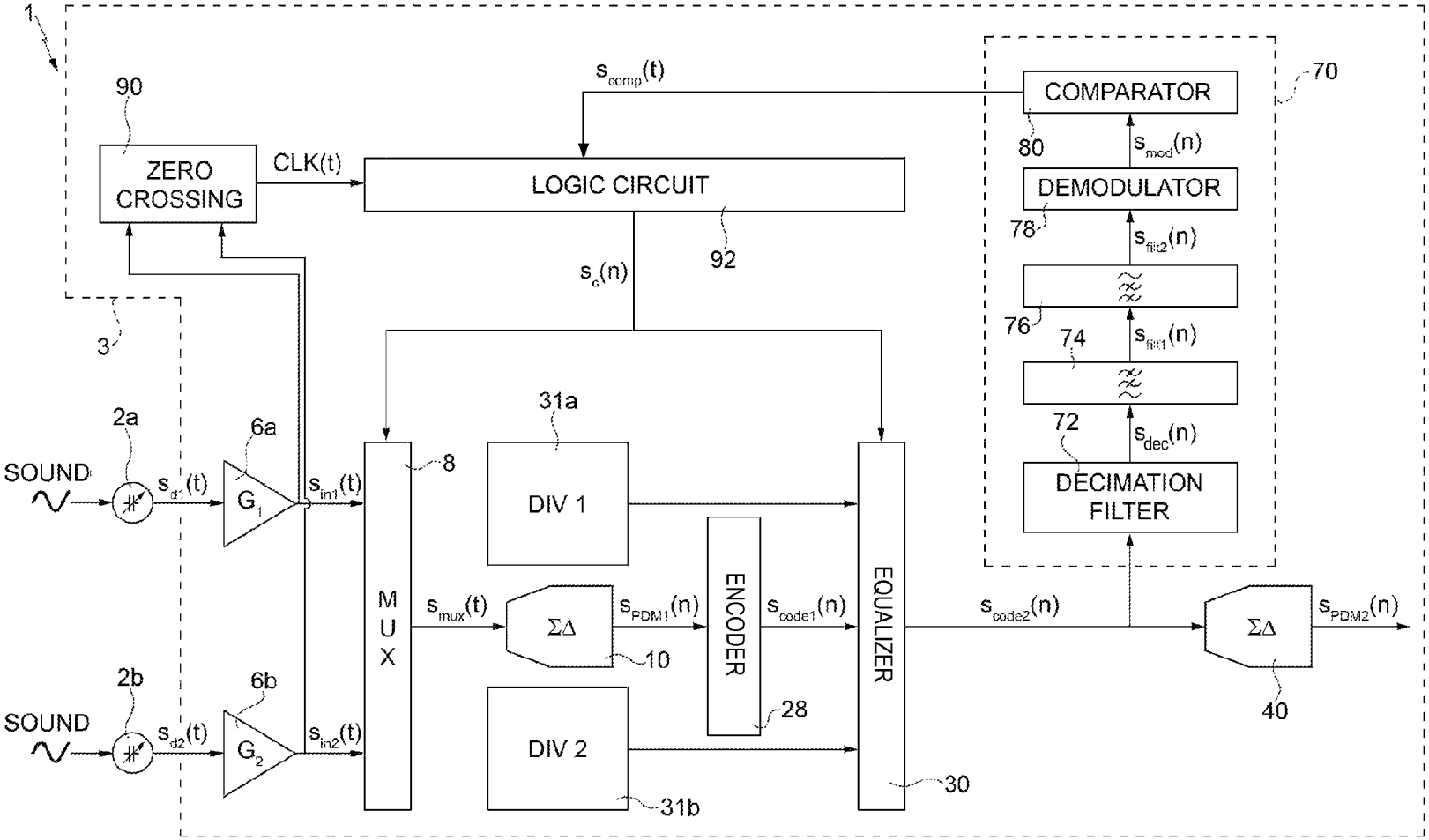
FIG. 1 shows a circuit diagram of a microphone including the present processing circuit.

The present processing circuit is described in what follows, without this implying any loss of generality, with reference to a digital microphone 1 illustrated in FIG. 1, thus with reference to detection of pressure signals; however, the present processing circuit may form a sensor of a different type, such as for example an inertial sensor formed by an accelerometer and/or a gyroscope.

In detail, the digital microphone 1 comprises a first sensing structure 2*a* and a second sensing structure 2*b*, of a per se known type. In what follows, it is assumed, without this implying any loss of generality, that the first and second sensing structures 2*a*, 2*b* are MEMS sensing structures of a capacitive type for acoustic transducers. The first and second sensing structures 2*a*, 2*b* are represented schematically in FIG. 1 by a respective capacitor having a capacitance that varies as a function of the acoustic signals that impinge upon it.

Each of the first and second sensing structures 2*a*, 2*b* may comprise a respective membrane, designed to undergo deformation as a function of the incident acoustic signals. In addition, the first and second sensing structures 2*a*, 2*b* present different mechanical characteristics, for example in terms of different rigidity to deformation, which determine different electrical characteristics as regards the capacity of detecting acoustic signals.

In detail, the first and second sensing structures 2*a*, 2*b* have different sensitivities and dynamic ranges. Without this implying any loss of generality, in what follows it is assumed that the first and second sensing structures 2*a*, 2*b* have, respectively, a first sensitivity $S_1$ and a second sensitivity $S_2$, as well as a first dynamic range $I_1$ and a second dynamic range $I_2$, the upper bounds of which are, respectively, $I_{max1}$ and $I_{max2}$. Without this implying any loss of generality, it is assumed that the first and second dynamic ranges $I_1$, $I_2$ partially overlap and that the first and second sensitivities $S_1$, $S_2$ are substantially constant within the first dynamic range $I_1$ and the second dynamic range $I_2$, respectively.

It is likewise assumed, once again by way of example, that the relations $S_1>S_2$ and $I_{max1}<I_{max2}$ apply; in other words, it is assumed that the first sensing structure 2*a* is designed to transduce signals that have low sound-pressure levels, and that the second sensing structure 2*b* is designed to transduce signals that have high sound-pressure levels. Purely by way of example, the first and second sensing structures 2*a*, 2*b* may be configured to detect signals that have maximum sound-pressure levels with acoustic overload point (AOP) for example equal to 120 dBSPL and 140 dBSPL, respectively. It is further possible, without this implying any loss of generality, for the first and second dynamic ranges $I_1$, $I_2$ to have the same breadth.

As described in greater detail hereinafter, the first and second sensing structures 2*a*, 2*b* may be formed, purely by way of example, by two portions of the same membrane, facing respective fixed electrodes, for forming two sensing capacitors. In this case, one of these two portions is a peripheral portion of the membrane, which is designed to detect signals with high sound-pressure levels, whereas the other is a central portion of the membrane, which undergoes greater elastic deformations and is thus designed to detect signals with low sound-pressure levels, given its higher sensitivity.

Irrespective of the details of implementation of the first and second sensing structures 2*a*, 2*b*, when an acoustic signal impinges upon the first and second sensing structures 2*a*, 2*b*, the latter supply at output, respectively, a first detection signal $s_{d1}(t)$ and a second detection signal $s_{d2}(t)$, of an analog type. For instance, the first and second detection signals $s_{d1}(t)$, $s_{d2}(t)$ may be voltage signals. In addition, the first detection signal $s_{d1}(t)$ has an amplitude greater than that of the second detection signal $s_{d2}(t)$.

The digital microphone 1 further comprises a processing circuit 3, which comprises a first amplification stage 6*a* and a second amplification stage 6*b*, which have inputs connected to the outputs of the first and second sensing structures 2*a*, 2*b*, respectively.

The first and second amplification stages 6*a*, 6*b* have a first gain $G_1$ and a second gain $G_2$, respectively, and supply on the respective outputs a first input signal $s_{in1}(t)$ and a second input signal $s_{in2}(t)$. In addition, it is found that $S_1 \cdot G_1 > S_2 \cdot G_2$; in particular, without this implying any loss of generality, in what follows it is assumed that $S_1 \cdot G_1 = 32 \cdot S_2 \cdot G_2$.

The processing circuit 3 further comprises a multiplexer 8 having two signal inputs, a control input, and an output, the two signal inputs being, respectively, connected to the outputs of the first and second amplification stages 6*a*, 6*b*. In use, the multiplexer 8 is designed to supply on its own output a multiplexed signal $s_{mux}(t)$, which is alternatively equal to the first input signal $s_{in1}(t)$ or else to the second input signal $s_{in2}(t)$, as a function of a control signal $s_c(n)$, present on the control input and described in greater detail hereinafter. In other words, as described in what follows, it is found that portions of the multiplexed signal $s_{mux}(t)$ are equal to corresponding portions of the first input signal $s_{in1}(t)$, whereas other portions of the multiplexed signal $s_{mux}(t)$ are equal to corresponding portions of the second input signal $s_{in2}(t)$.

The processing circuit 3 likewise comprises a first converter 10 of an analog-to-digital type. In particular, the first converter 10 is a so-called sigma-delta converter, of a per se known type, designed to receive at input the multiplexed signal $s_{mux}(t)$ and to supply at output a first PDM signal $s_{PDM1}(n)$. In what follows, the first converter 10 is referred to as "first sigma-delta converter 10".

Figure 2:
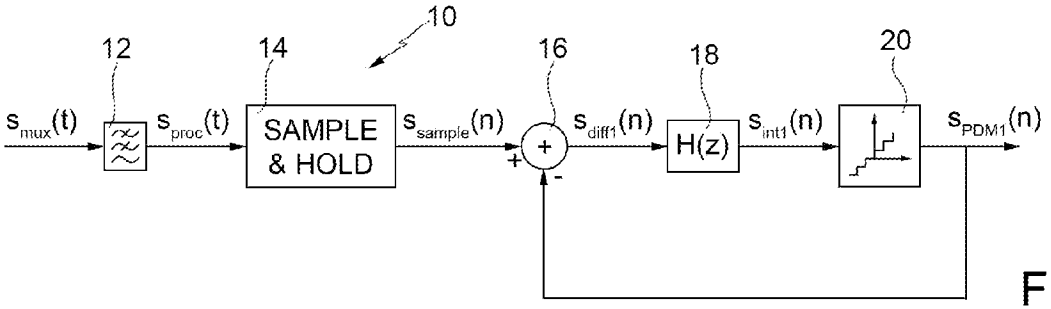
FIGS. 2 and 4 show circuit diagrams of portions of the microphone illustrated in FIG. 1.

In detail, without this implying any loss of generality, the first sigma-delta converter 10 carries out a conversion according to the diagram illustrated in FIG. 2 and thus comprises an input filter 12 of an analog type, a sample-and-hold 14, a first adder 16, a first loop filter 18, and a first quantizer 20.

In greater detail, the input filter 12 is of a low-pass type and functions as anti-aliasing filter. In addition, the input filter 12 has an output and an input, the latter being connected to the output of the multiplexer 8 so that the input filter 12 receives the multiplexed signal $s_{mux}(t)$ and supplies on the respective output a signal to be processed $s_{proc}(t)$. In particular, the input filter 12 is such that the signal to be processed $s_{proc}(t)$ has a frequency band equal to $f_0$.

The sample-and-hold 14 has a respective input connected to the output of the input filter 12 and operates at a sampling frequency $f_s$, for example equal to 3.072 MHz; consequently, the sample-and-hold 14 supplies on a respective output a sampled signal $s_{sample}(n)$. More in particular, we have $f_s/2>f_0$ so that the sample-and-hold 14 carries out an oversampling of the signal to be processed $s_{proc}(t)$.

The first adder 16 has an output, and a first input and a second input; the first input is connected to the output of the sample-and-hold 14. In addition, the first adder 16 supplies on its own output a first difference signal $s_{diff1}(n)$, which, as described hereinafter, is equal to the difference between the two signals present on its own first and second inputs.

The first loop filter 18 is of a digital type and has an input and an output, the input being connected to the output of the first adder 16. In addition, the first loop filter 18 supplies on its own output a first processed signal $s_{int1}(n)$.

Purely by way of example, the first loop filter 18 may be formed by an integrator, in which case the first sigma-delta converter 10 is of the first order; however possible are embodiments in which the first sigma-delta converter 10 is of a higher order. For instance, without this implying any loss of generality, embodiments are possible in which the first sigma-delta converter 10 is of the fourth order, in which case it has a corresponding block structure, of a per se known type.

The first quantizer 20 has an input and an output, which are, respectively, connected to the output of the first loop filter 18 and to the second input of the first adder 16. In addition, the first quantizer 20 supplies on its own output a first quantized signal, referred to as first PDM signal $s_{PDM1}(n)$.

Thus, given the feedback described, we have $s_{diff1}(n)=s_{sample}(n)-s_{PDM1}(n)$. Without this implying any loss of generality, in what follows it is assumed that the first quantizer 20 is a single-bit quantizer, and thus that the first PDM signal $s_{PDM1}(n)$ is formed by a stream of samples, each encoded on a single bit. In practice, the first PDM signal $s_{PDM1}(n)$ is formed by a PDM bitstream.

In a per se known manner, the first sigma-delta converter 10 thus converts the multiplexed signal $s_{mux}(t)$ into the first PDM signal $s_{PDM1}(n)$.

The processing circuit 3 further comprises an encoder 28, which has an output and an input, the latter being connected to the output of the first sigma-delta converter 10, and in particular to the output of the first quantizer 20. The encoder 28 then receives the first PDM signal $s_{PDM1}(n)$ and supplies on its own output a first encoded signal $s_{code1}(n)$.

Without this implying any loss of generality, the first encoded signal $s_{code1}(n)$ is formed in the following way. For each bit of the first PDM signal $s_{PDM1}(n)$ present at input to the encoder 28, the encoder 28 supplies on its own output a pair of bits equal to:

"01", if the bit at input is "1"; or else

"11", if the bit at input is "0".

In practice, the first encoded signal $s_{code1}(n)$ is a two's complement representation of a stream of samples such that, for each bit of the first PDM signal $s_{PDM1}(n)$, the stream of samples includes a corresponding sample equal to 1 if the bit of the first PDM signal $S_{PDM1}(n)$ is "1", or else equal to −1 if the bit of the first PDM signal $s_{PDM1}(n)$ is "0".

The processing circuit 3 further comprises an equalizer 30, which has a signal input, a control input, a first additional input and a second additional input, and an output; further, the processing circuit 3 comprises a first memory block 31*a* and a second memory block 31*b*, which store a first coefficient DIV1 and a second coefficient DIV2, respectively.

In what follows, it is assumed, purely by way of example, that the first and second coefficients DIV1, DIV2 are, respectively, equal to 1/32 and 1. In addition, it is assumed, without this implying any loss of generality, that that the following relation applies: $S_1 \cdot G_1 \cdot DIV1 = S_2 \cdot G_2 \cdot DIV2$.

In detail, the signal input of the equalizer 30 is connected to the output of the encoder 28, whereas the first and the second additional inputs are connected to the first memory block 31*a* and to the second memory block 31*b*, respectively. Without this implying any loss of generality, it is assumed that the connection between the output of the encoder 28 and the signal input of the equalizer 30 is of a parallel type so that the encoder 28 generates the aforementioned pairs of bits at a frequency equal to the sampling frequency $f_s$.

Present on the control input of the equalizer 30 is the aforementioned control signal $s_c(n)$.

In use, the equalizer 30 supplies on its own output a second encoded signal $s_{code2}(n)$, as a function of the first encoded signal $s_{code1}(n)$ and according to one between the first and second coefficients DIV1, DIV2. In particular, the equalizer 30 selects, as described hereinafter, a coefficient between the first and second coefficients DIV1, DIV2 and determines the samples of the second encoded signal $s_{code2}(n)$ on the basis of the samples of the first encoded signal $s_{code1}(n)$ and of the coefficient selected.

In detail, for each of the samples of the first PDM signal $s_{PDM1}(n)$, and thus for each pair of consecutive bits of the first encoded signal $s_{code1}(n)$, the equalizer 30 generates a corresponding sample, which is encoded with two's complement on a number of bits for example equal to seven. In addition, without this implying any loss of generality, the frequency at which the samples of the second encoded signal $s_{code2}(n)$ are generated is equal to the sampling frequency $f_s$; consequently, the output of the equalizer 30 is of a parallel and thus multibit type.

Figure 3A:
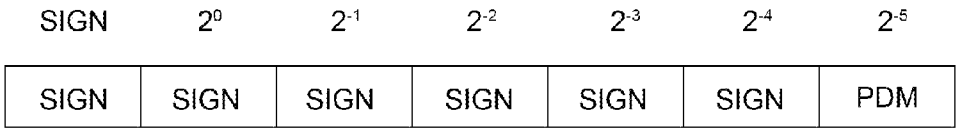
FIGS. 3*a* and 3*b* are schematic representations of two different types of binary encoding of samples.
Figure 3B:
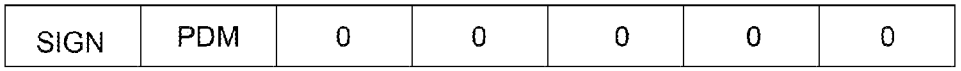

As illustrated in greater detail in FIGS. 3*a* and 3*b*, if the coefficient selected is the first coefficient DIV1 (FIG. 3*a*), for each sample of the first PDM signal $s_{PDM1}(n)$, and thus for each corresponding pair of bits of the first encoded signal $s_{code1}(n)$, we have that:

- if the sample of the first PDM signal $s_{PDM1}(n)$ is equal to "1", and thus if the corresponding pair of bits of the first encoded signal $s_{code1}(n)$ is equal to "01", the equalizer 30 generates the following set of seven bits: "0000001";
- if the sample of the first PDM signal $s_{PDM1}(n)$ is equal to "0", and thus if the corresponding pair of bits of the first encoded signal $s_{code1}(n)$ is equal to "11", the equalizer 30 generates the following set of seven bits: "1111111".

In other words, the first six bits of the aforementioned set of seven bits are equal to the bit that indicates the sign within the two's complement notation of the first encoded signal $s_{code1}(n)$. In addition, assuming that the second, third, fourth, fifth, sixth, and seventh bits of the set of seven bits are associated to weights, respectively, equal to $2^0$, $2^{-1}$, $2^{-2}$, $2^{-3}$, $2^{-4}$, and $2^{-5}$, we have that the sample of the second encoded signal $s_{code2}(n)$, which is encoded in fixed-point two's complement by the aforementioned set of seven bits, is alternatively equal to 1/32 (if the pair of bits of the first encoded signal $s_{code1}(n)$ is equal to "01") or −1/32 (if the pair of bits of the first encoded signal $s_{code1}(n)$ is equal to "11").

In addition, if the coefficient selected is the second coefficient DIV2 (FIG. 3*b*), for each sample of the first PDM signal $s_{PDM1}(n)$, and thus for each corresponding pair of bits of the first encoded signal $s_{code1}(n)$, we have that:

if the sample of the first PDM signal $s_{PDM1}(n)$ is equal to "1", and thus if the corresponding pair of bits of the first encoded signal $s_{code1}(n)$ is equal to "01", the equalizer 30 generates the following set of seven bits: "0100000";

if the sample of the first PDM signal $s_{PDM1}(n)$ is equal to "0", and thus if the corresponding pair of bits of the first encoded signal $s_{code1}(n)$ is equal to "11", the equalizer 30 generates the following set of seven bits: "1100000".

In other words, the first of the seven bits is equal to the bit that indicates the sign within the two's complement notation of the first encoded signal $s_{code1}(n)$. In addition, assuming once again that the second, third, fourth, fifth, sixth, and seventh bits of the set of seven bits are associated to weights, respectively, equal to $2^0$, $2^{-1}$, $2^{-2}$, $2^{-3}$, $2^{-4}$, and $2^{-5}$, we have that the sample of the second encoded signal $s_{code2}(n)$, which is once again encoded in fixed-point two's complement by the aforementioned set of seven bits, is alternatively equal to 1 (if the pair of bits of the first encoded signal $s_{code1}(n)$ is equal to "01") or −1 (if the pair of bits of the first encoded signal $s_{code1}(n)$ is equal to "11").

In practice, the equalizer 30 operates as a numeric divider, since it carries out a two's complement binary division, where the divisor is alternatively equal to 1/DIV1 or else 1/DIV2 and is selected on the basis of the control signal $s_c(n)$, as described in detail in what follows.

The processing circuit 3 further comprises a second converter 40 of the digital-to-digital type. In particular, the second converter 40 is a so-called sigma-delta converter, of a per se known type, designed to receive at input the second encoded signal $s_{code2}(n)$ and to supply at output a second PDM signal $s_{PDM2}(n)$. In what follows, the second converter 40 is referred to as "second sigma-delta converter 40".

Figure 4:
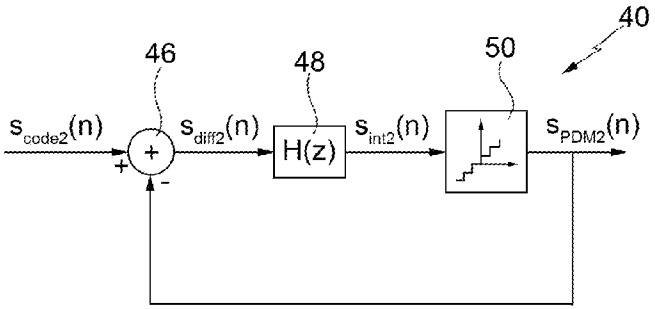

Without this implying any loss of generality, the second sigma-delta converter 40 carries out a conversion according to the scheme illustrated in FIG. 4 and thus comprises a second adder 46, a second loop filter 48, and a second quantizer 50.

In greater detail, the second adder 46 has an output and a first input and a second input; the first input is connected to the output of the equalizer 30 for receiving the second encoded signal $s_{code2}(n)$.

In addition, the second adder 46 supplies on its own output a second difference signal $s_{diff2}(n)$, which, as described hereinafter, is equal to the difference between the two signals present on its own first and second inputs. In the embodiment described, the samples of the second difference signal $s_{diff2}(n)$ are encoded in fixed-point two's complement, on seven bits.

The second loop filter 48 is of a digital type and has an input and an output, the input being connected to the output of the second adder 46. In addition, the second loop filter 48 filters the samples of the second difference signal $s_{diff2}(n)$ and supplies on its own output a second processed signal $s_{int2}(n)$. Purely by way of example, the second loop filter 48 may be formed by an integrator, in which case the second sigma-delta converter 40 is of the first order; however possible are embodiments in which the second sigma-delta converter 40 is of a higher order, for example equal to four, in which case it has a corresponding block structure, of a per se known type.

The second quantizer 50 has an input and an output, which are, respectively, connected to the output of the second loop filter 48 and to the second input of the second adder 46. In addition, the second quantizer 50 supplies on its own output a second quantized signal, referred to hereinafter as "second PDM signal $s_{PDM2}(n)$". Consequently, given the feedback described, we have $s_{diff2}(n)=s_{code2}(n)-s_{PDM2}(n)$.

Without this implying any loss of generality, in what follows it is assumed that the second quantizer 50 is a single-bit quantizer, and thus that the second PDM signal $s_{PDM2}(n)$ is formed by a stream of samples, each encoded on a single bit; these samples are supplied at a frequency equal to the sampling frequency $f_s$. It is further assumed that, in order to calculate $s_{diff2}(n)=s_{code2}(n)-s_{PDM2}(n)$, the second adder 46 will convert the samples of the second PDM signal $s_{PDM2}(n)$ for encoding them in fixed-point two's complement, on seven bits.

In practice, the second sigma-delta converter 40 converts the second encoded signal $s_{code2}(n)$, where the samples are encoded on a number of bits, into the second PDM signal $s_{PDM2}(n)$, where each sample is encoded on a single bit.

The processing circuit 3 further comprises a processing stage 70, which in turn comprises a decimation filter 72, the input of which is connected to the output of the equalizer 30 for receiving the second encoded signal $s_{code2}(n)$. On its own output, the decimation filter 72 supplies a decimated signal $s_{dec}(n)$.

In detail, the decimation filter 72, for example, has a pulse response of a so-called "sinc function" type, the order of which may, for example, be equal to K+1, where K is the order of the first converter 10. In addition, the decimation filter 72 decimates the samples of the second encoded signal $s_{code2}(n)$; for example, the decimation filter 72 may discard three samples out of four of the second encoded signal $s_{code2}(n)$, in which case the samples of the decimated signal $s_{dec}(n)$ are supplied at a frequency equal to one quarter of the sampling frequency $f_s$, the output of the decimation filter 72 being again of a parallel type. For practical purposes, the decimation filter 72 removes the quantization noise introduced by the first quantizer 20.

The processing stage 70 further comprises a first processing filter 74, the input of which is connected to the output of the decimation filter 72.

The first processing filter 74 is of the so-called IIR (infinite impulse response) type and is, for example, a third-order filter with bandwidth limited to the audio bandwidth, i.e., with 3-dB frequency of 20 kHz. In addition, the first processing filter 74, by filtering the samples of the decimated signal $s_{dec}(n)$, supplies a first filtered signal $s_{filt1}(n)$ on its own output.

The processing stage 70 further comprises a second processing filter 76, the input of which is connected to the output of the first processing filter 74.

The second processing filter 76 is a high-pass filter of a type IIR, which performs the function of removing the d.c. component of the first filtered signal $s_{filt1}(n)$.

In addition, the second processing filter 76 supplies a second filtered signal $s_{filt2}(n)$ on its own output.

The processing stage 70 further comprises a demodulation stage 78, the input of which is connected to the output of the second processing filter 76. The demodulation stage 78 is designed to generate on its own output a (digital) modulus signal $s_{mod}(n)$, indicating the envelope of the modulus of the second filtered signal $s_{filt2}(n)$. For this purpose, the demodulation stage 78 may, for example, be formed by a so-called peak detector. Consequently, the demodulation stage 78 calculates the modulus of the samples of the second filtered signal $s_{filt2}(n)$ and carries out a numeric filtering of the samples thus obtained. Without this implying any loss of generality, the filtering may be carried out so that the increases in value of the envelope of the modulus of the second filtered signal $s_{filt2}(n)$ are followed rapidly by the demodulation stage 78, while the reductions in value of the envelope of the modulus of the second filtered signal $s_{filt2}(n)$ are followed more slowly; in other words, the demodulation stage 78 may track the increases and reductions in the value of the envelope of the modulus of the second filtered signal $s_{filt2}(n)$ with two different time constants.

Figure 5:
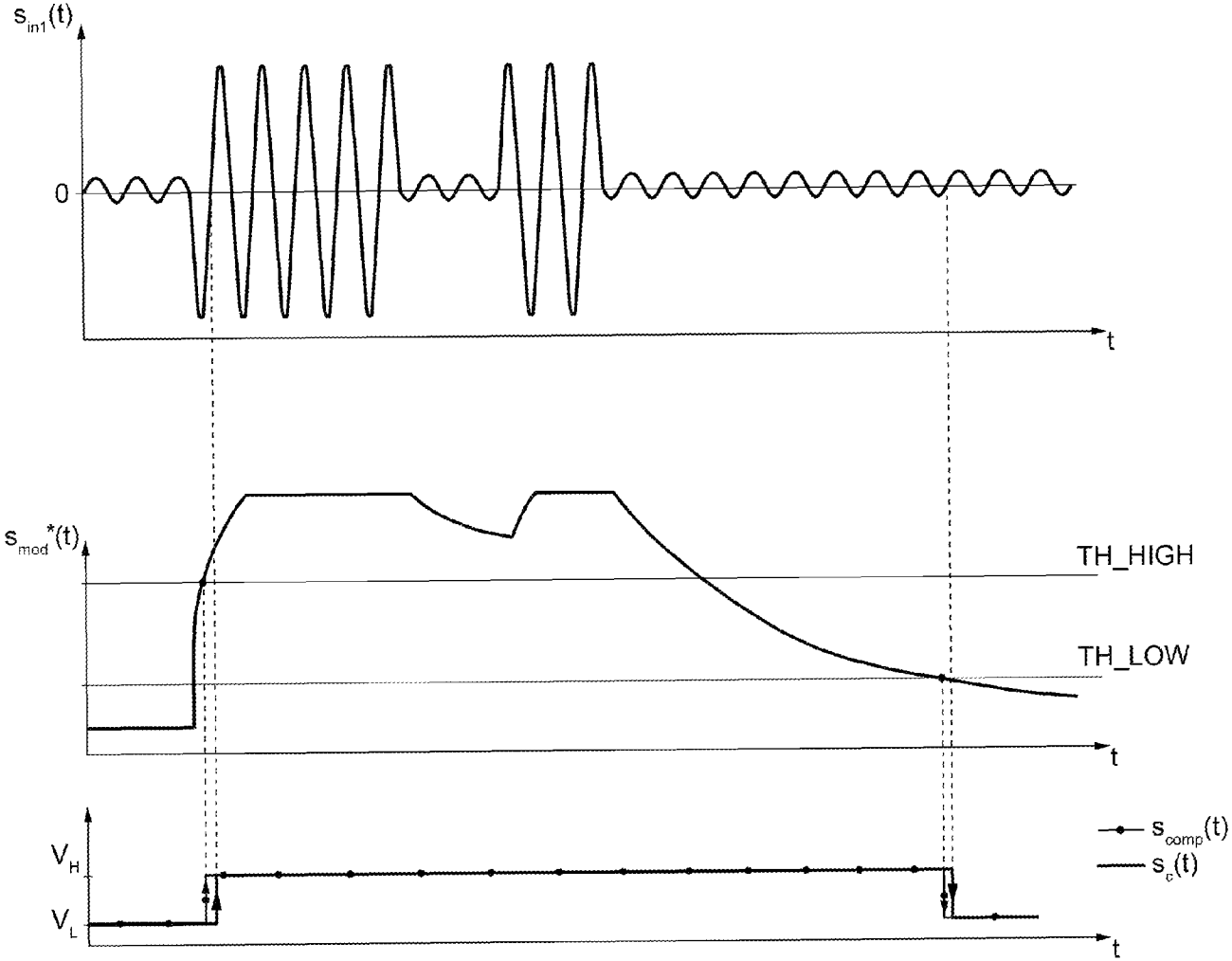
FIG. 5 shows time plots of electrical signals generated within the present processing circuit.

An example of the modulus signal $s_{mod}(n)$ is shown in FIG. 5, together with an example of the first input signal $s_{in1}(t)$; more precisely, for reasons of clarity, illustrated in FIG. 5 is a continuous-time version of the modulus signal $s_{mod}(n)$, designated by $s_{mod}*(t)$ and may be obtained by interpolating the samples of the modulus signal $s_{mod}(n)$ itself. For practical purposes, the modulus signal $s_{mod}(n)$ functions as power-measurement signal, since it indicates the power of the second encoded signal $s_{code2}(n)$; further, the modulus signal $s_{mod}(n)$ indicates the sound-pressure level of the acoustic signal that impinges upon the first and second sensing structures 2*a*, 2*b*.

The processing stage 70 further comprises a comparator 80, the input of which is connected to the output of the demodulation stage 78. In addition, the comparator 80 is designed to generate on its own output a comparison signal $s_{comp}(t)$ of an analog type, an example of which is illustrated in FIG. 5, together with a corresponding example of the control signal $s_c(n)$.

In particular, the comparator 80 compares the modulus signal $s_{mod}(n)$ with a first threshold TH_HIGH and a second threshold TH_LOW, with TH_HIGH>TH_LOW; purely by way of example, the difference TH_HIGH-TH_LOW may, for example, be equal to 6 dBSPL.

Whenever the modulus signal $s_{mod}(n)$ exceeds the first threshold TH_HIGH, the comparator 80 generates a rising edge of the comparison signal $s_{comp}(t)$, which assumes a value $V_H$. Instead, whenever the modulus signal $s_{mod}(n)$ drops below the second threshold TH_LOW, the comparator 80 generates a falling edge of the comparison signal $s_{comp}(t)$, which assumes a value $V_L$.

The processing circuit 3 further comprises a zero-detection circuit 90 and a logic circuit 92.

The zero-detection circuit 90 has two inputs and an output; the two inputs are, respectively, connected to the outputs of the first and second amplification stages 6*a*, 6*b*, so that the zero-detection circuit 90 receives at input the first input signal $s_{in1}(t)$ and the second input signal $s_{in2}(t)$. In addition, the zero-detection circuit 90 supplies a clock signal CLK(t) on its own output.

The zero-detection circuit 90 generates a pulse of the clock signal CLK(t) whenever one between the first and second input signals $s_{in1}(t)$, $s_{in2}(t)$ crosses the respective zero value, the rising edge of this pulse being substantially concomitant with zero-crossing by the first input signal $s_{in1}(t)$ or the second input signal $s_{in2}(t)$, and thus also with the instant of zero-crossing by the first detection signal $s_{d1}(t)$ or by the second detection signal $s_{d2}(t)$, on the hypothesis of considering negligible the delays introduced by the first and second amplification stages 6*a*, 6*b*. In this connection, the adverb "substantially" refers to the hypothesis of neglecting the inevitable delays of switching of the output of the zero-detection circuit 90, due for example to the delays in the propagation of the signals within the zero-detection circuit 90 itself. Further, in general, in the present description it is assumed that the times of propagation of the signals within the digital microphone 1 are neglected.

The logic circuit 92 has a first input and a second input, connected, respectively, to the output of the comparator 80 and to the output of the zero-detection circuit 90, and an output, which is connected to the control inputs of the multiplexer 8 and of the equalizer 30. In addition, the logic circuit 92 supplies the aforementioned control signal $s_c(n)$ on its own output.

In detail, the logic circuit 92 operates as a so-called "edge-triggered D flip-flop", where the datum is constituted by the comparison signal $s_{comp}(t)$ and the clock is constituted precisely by the clock signal CLK(t), so that the instant of (possible) switching of the output of the logic circuit 92 is determined by the clock signal CLK(t). For instance, without this implying any loss of generality, it is assumed that the instants of (possible) switching of the output of the logic circuit 92 substantially coincide (i.e., but for the inevitable switching delays of the output of the logic circuit 92) with the rising edges of the pulses of the clock signal CLK(t). Consequently, at each rising edge of the clock signal CLK(t), the control signal $s_c(n)$ assumes the value that the comparison signal $s_{comp}(t)$ has at the moment identified by this rising edge. It follows that the control signal $s_c(n)$ assumes alternatively the value $V_H$ or else the value $V_L$.

In practice, in this embodiment, the control signal $s_c(n)$ has a rising edge or a falling edge concomitant with instants of zero-crossing by the first detection signal $s_{d1}(t)$ or by the second detection signal $s_{d2}(t)$. In addition, since one between the first and second input signals $s_{in1}(t)$, $s_{in2}(t)$ is in advance with respect to the other, zero-crossing by the signal in advance is followed in a short time by zero-crossing by the other signal; however, whereas the initial crossing may cause switching of the value of the control signal $s_c(n)$, the subsequent crossing does not cause any switching of the value of the control signal $s_c(n)$, since, between the initial crossing and the next crossing, there does not occur any switching of the value of the comparison signal $s_{comp}(t)$. It should further be noted that, for simplicity, in FIG. 5 reference is made to a different embodiment, where the clock signal CLK(t) is formed on the basis of just one between the first and second input signals $s_{in1}(t)$, $s_{in2}(t)$, and in particular on the basis of the first input signal $s_{in1}(t)$; in this case, the clock signal CLK(t) comprises a pulse for each zero-crossing by the first input signal $s_{in1}(t)$.

This having been said, the multiplexer 8 is configured so that:

- when the control signal $s_c(n)$ has a value equal to $V_L$, thus in the presence of an acoustic signal having a low level of sound pressure, and thus of power, the multiplexed signal $s_{mux}(t)$ is equal to the first input signal $s_{in1}(t)$; whereas
- when the control signal $s_c(fl)$ has a value equal to $V_H$, thus in the presence of an acoustic signal having a high level of sound pressure, and thus of power, the multiplexed signal $s_{mux}(t)$ is equal to the second input signal $s_{in2}(t)$.

In addition, the equalizer 30 is configured so that:

- when the control signal $s_c(n)$ has a value equal to $V_L$, the aforementioned selected coefficient is equal to the first coefficient DIV1; whereas
- when the control signal $s_c(n)$ has a value equal to $V_H$, the aforementioned selected coefficient is equal to the second coefficient DIV2.

In practice, the equalizer 30 varies the coefficient used by it at the same instants in which the multiplexer 8 changes the input signal, on the basis of which it generates the multiplexed signal $s_{mux}(t)$. In addition, the equalizer 30 implements an equalization of the sensitivity-gain products regarding the first and second sensing structures 2*a*, 2*b*. In addition, the first PDM signal $s_{PDM1}(n)$ is formed, at each instant, on the basis of the detection signal supplied by the most appropriate sensing structure, i.e., the sensing structure that is not in saturation and that has the highest sensitivity-gain product possible, compatibly with the sound-pressure level of the acoustic signal. In addition, since the equalizer 30 switches between the first and second coefficients DIV1, DIV2 substantially at the zeros of the acoustic signal, the distortions introduced by this switching on the signals downstream of the equalizer 30 are limited.

Figure 6:
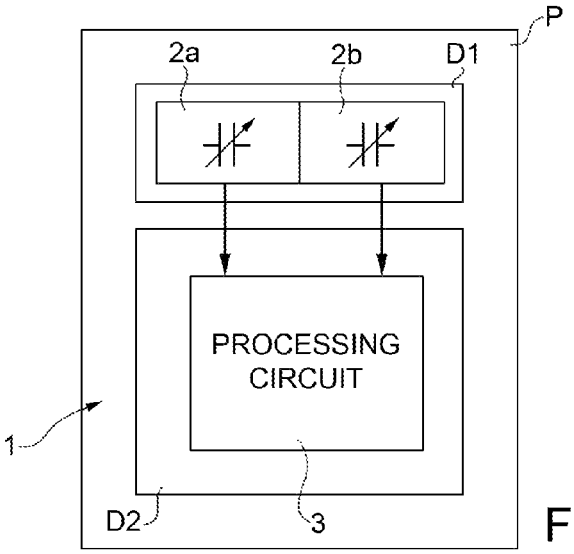
FIG. 6 shows a block diagram of a package containing the microphone illustrated in FIG. 1.

As illustrated in FIG. 6, the digital microphone 1 may be formed within a package P, which includes a first die $D_1$ and a second die $D_2$. In this case, the first die $D_1$ forms the first and second sensing structures 2*a*, 2*b*, whereas the second die $D_2$ forms the processing circuit 3, for example in the form of a so-called application-specific integrated circuit (ASIC). In addition, even though not illustrated, in the second die $D_2$ there may be formed, for example, a charge pump, electrically connected to the first and second sensing structures 2*a*, 2*b*. However, also possible are variants in which, for instance, also the processing circuit 3 is formed in the first die $D_1$, in which case it is further possible for the second sensing structure 2*b* to be formed once again in the first die $D_1$ or else in the second die $D_2$.

Figure 7:
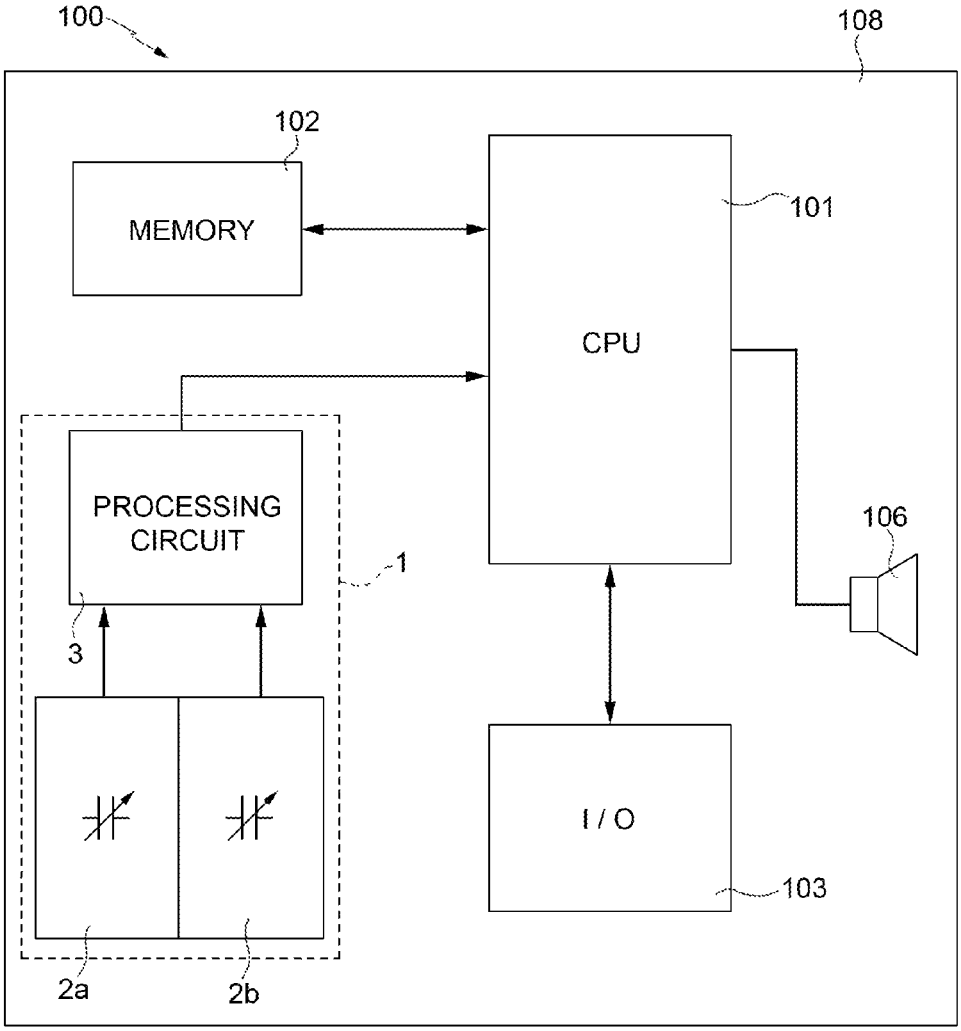
FIG. 7 shows a block diagram of an electronic device that incorporates the microphone illustrated in FIG. 1.

As illustrated in FIG. 7, irrespective of the details of implementation, the digital microphone 1 may form an electronic device 100.

The electronic device 100 is, for example, a mobile communication device, such as a cellphone, a personal digital assistant, a notebook, but also a voice recorder, a reader of audio files with voice-recording capacity, etc. Alternatively, the electronic device 100 may be a hydrophone, capable of working under water, or else a hearing-aid device.

The electronic device 100 comprises a microprocessor 101, a device memory 102, connected to the microprocessor 101, and an input/output interface 103, which is for example formed by a keypad and a screen and is also connected to the microprocessor 101.

The digital microphone 1 communicates with the microprocessor 101; in particular, the processing circuit 3 sends the aforementioned second PDM signal $s_{PDM2}(n)$ to the microprocessor 101, possibly after prior further processing by an electronic interface circuit (not illustrated).

The electronic device 100 further comprises a speaker 106, which is connected to the microprocessor 101 and is designed to generate sounds on an audio output (not illustrated) of the electronic device 100. In addition, the digital microphone 1, the microprocessor 101, the device memory 102, the input/output interface 103, and the speaker 106 are mounted, for example, on a single printed circuit board (PCB) 108, for instance with the surface-mount technique.

Figure 8:
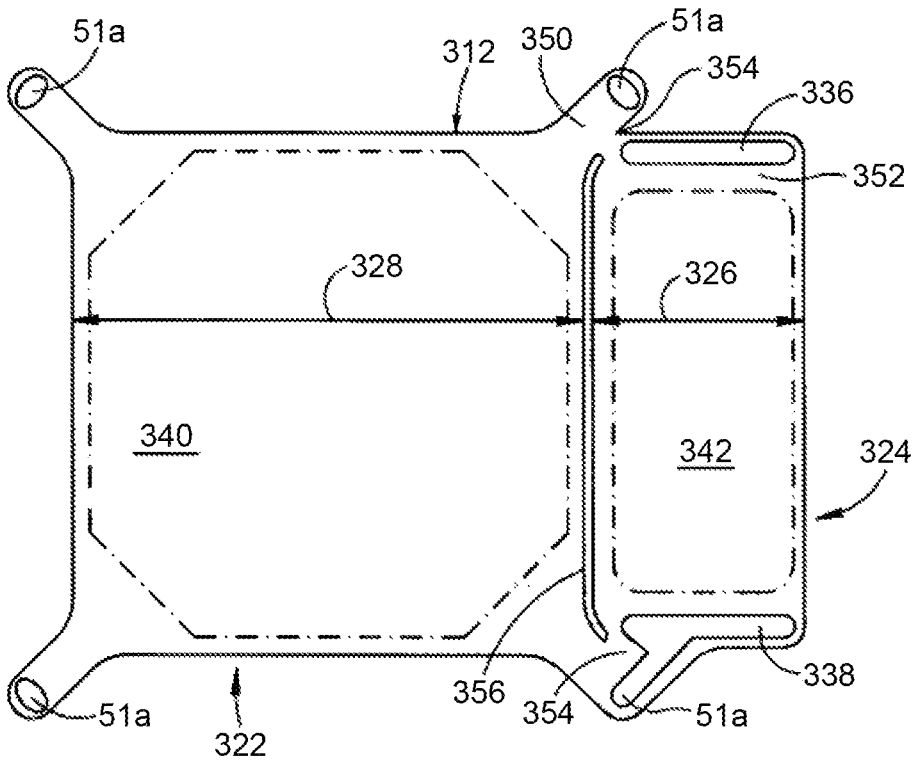
FIG. 8 is a perspective view of a membrane configured to be incorporated in the microphone illustrated in FIG. 1.
Figure 9:
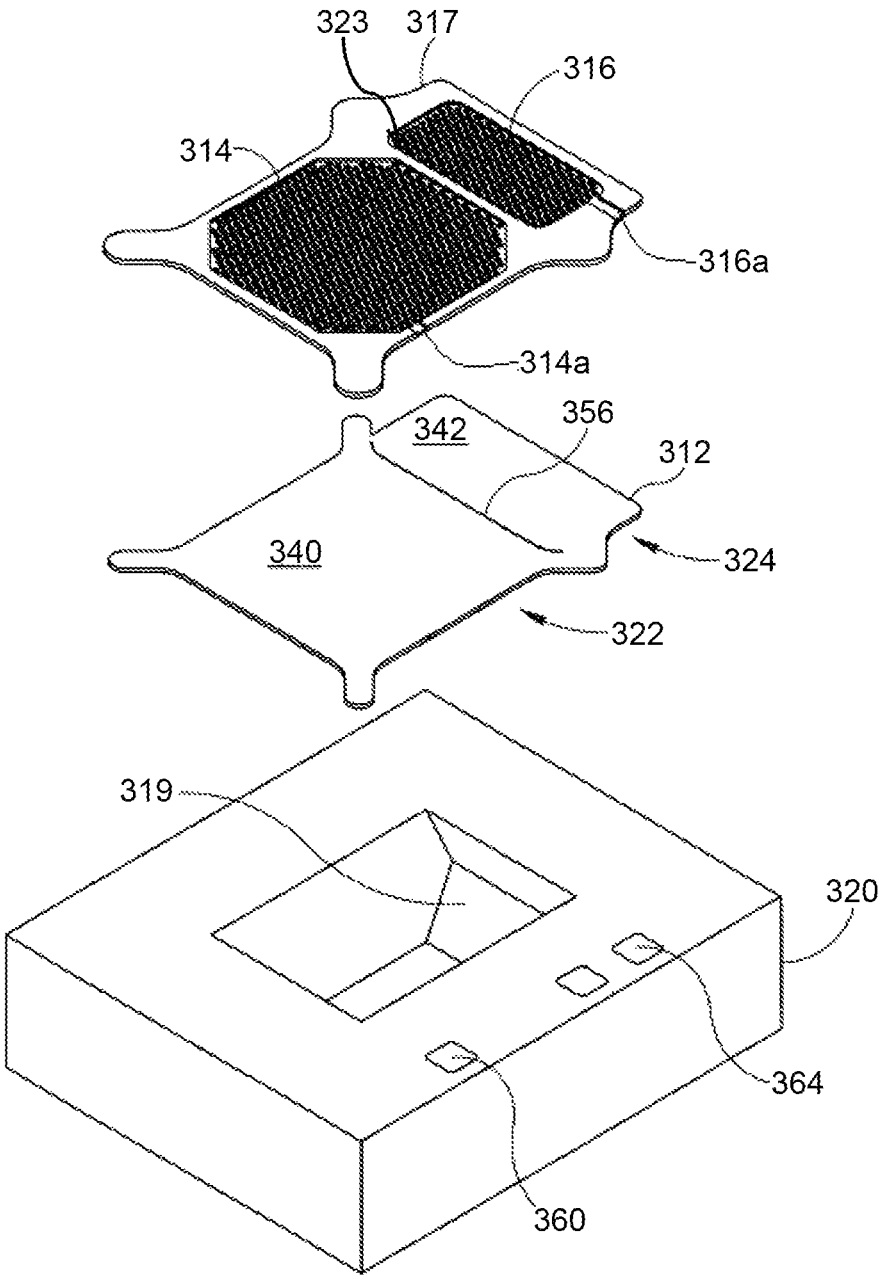
FIG. 9 is an exploded view of the membrane illustrated in FIG. 8.

FIGS. 8 and 9 are, respectively, a plan view and an exploded view of a vibrating membrane 312, which is configured to be integrated, for example, in the digital microphone 1, illustrated in FIG. 1. In FIG. 9, the vibrating membrane 312 is positioned between a fixed protective membrane 317 and a substrate 320. The substrate 320 includes a chamber 319, positioned on top of which is the vibrating membrane 312.

The vibrating membrane 312 includes two vibrating portions, and in particular a first portion 340 and a second portion 342. The first and second portions may represent the first and second sensing structures 2*a*, 2*b* of FIG. 1. The first portion 340 is separated from the second portion 342 by a slit 356. The first portion 340 has a wider area than the second portion 342. The first portion 340 forms a main membrane 322, from which a peripheral membrane 324 extends, formed by the second portion 342. Both the main membrane 322 and the peripheral membrane 324 are configured to detect acoustic signals through the capacitive interaction with electrodes in the protective membrane 317; however, the main membrane 322 and the peripheral membrane 324 are configured to have a different sensitivity. For instance, the main membrane 322 has a wider surface area, which is further away, as compared to the peripheral membrane 324, from anchorages 51*a*. This wider surface area enables detection of higher-frequency signals. The peripheral membrane 324, with smaller surface area, enables instead detection of lower-frequency signals.

The slit 356 between the main membrane 322 and the peripheral membrane 324 does not physically separate the first portion 340 in a complete way from the second portion 342, but leaves a connection in points 354. In this embodiment, the slit 356 has a rectilinear central region and curved external portions. The external portions bend, moving away from the center of the main membrane 322, towards the peripheral membrane 324. The partial separation of the main membrane 322 and of the peripheral membrane 324 enables simplification of the manufacturing process so that the vibrating membrane 312 is formed as a single layer of material in which the slit 356 is subsequently formed. In any case possible are embodiments in which the main membrane 322 and the peripheral membrane 324 are completely separated from one another, i.e., embodiments in which the slit 356 extends as far as the edges of the vibrating membrane 312.

As mentioned previously, the vibrating membrane 312 includes a plurality of anchorages 51*a*, i.e., of fixed portions, which are arranged at the ends of corresponding extended portions 350. The peripheral membrane 324 is fixed to anchorage regions 336 in respective edge portions 352 arranged on the bottom and top sides. The extended portions 350 extend from four corners of the main membrane 322. Each extended portion 350 has a constant width and a rounded end. The two anchorages 51*a* closest to the peripheral portion 324 join to the edge portions 352 in the points 354. In addition, the slit 356 separates the extended portions 350 from the edge portions 352 in the proximity of the points 354. In the embodiment illustrated in FIG. 8, the anchorage 51*a* and an anchorage region 338 on the bottom right-hand side of the image are connected to one another. By adjusting the shape and configuration of the anchorages, it is possible to adjust the sensitivity.

The vibrating membrane 312 is configured so that the ratio of the area of the anchorages 51*a* of the main membrane 322 with respect to the area of the main membrane 322 is less than the ratio of the area of the anchorage regions 336 of the peripheral membrane 324 with respect to the area of the peripheral membrane 324. Consequently, this entails that, in use, the main membrane 322 is moved further away from the peripheral membrane 324.

Since the slit 356 is formed only in a part of the vibrating membrane 312, the main membrane 322 and the peripheral membrane 324 are physically and electrically connected together. In an alternative embodiment, the slit 356 is not formed, so that the main membrane 322 and the peripheral membrane 324 are adjacent to one another and, consequently, the displacement of the main membrane 322 and the displacement of the peripheral membrane 324 affect one another. On the opposite side, in this embodiment, since the slit 356 is present, the main membrane 322 and the peripheral membrane 324 are separated from one another, determining a more significant difference between the displacements of the main membrane 322 and of the peripheral membrane 324.

The protective membrane 317 includes a first fixed electrode 314, arranged on top of the main membrane 322, and is configured to form a capacitor with the main membrane 322. The protective membrane 317 further includes a second fixed electrode 316, arranged on top of the peripheral membrane 324, and is configured to form a capacitor with the peripheral membrane 324. The protective membrane 317 provides support for the first and second fixed electrodes 314, 316, which may be fixed to a surface of the protective membrane 317 that is located in front of the vibrating membrane 312. The protective membrane 317 may be solid, i.e., without holes. Alternatively, the protective membrane 317 may have numerous openings, configured to enable release etching during the manufacturing process, which may also provide outlets for passage of air during operation.

The protective membrane 317 further includes an insulation bridge 323 positioned between the first fixed electrode 314 and the second fixed electrode 316. The insulation bridge 323 is made of a dielectric material and is arranged over the slit 356 between the main membrane 322 and the peripheral membrane 324.

Illustrated in FIG. 8 is just the outline of the first fixed electrode 314 and of the second fixed electrode 316, see the dashed lines. The first fixed electrode 314 is associated to the main membrane 322, which is square and wider than the peripheral membrane 324. The corners of the first fixed electrode 314 are arranged so that the overall shape is octagonal. The second fixed electrode 316 is rectangular and is associated to the peripheral membrane 324, which is also rectangular. The main membrane 322 has a first dimension 328, larger than a second dimension 326 of the peripheral membrane 324. In alternative embodiments, the shapes of the first and second fixed electrodes 314, 316, of the main membrane 322, and of the peripheral membrane 324 may vary. In an alternative embodiment, the first dimension and the second dimension of the electrodes may be the same or in any case very similar. The differences in dimensions cause generation of different signals and are such as to guarantee different sensitivities of detection.

The protective membrane 317 may be arranged at a single potential, or else the first and second fixed electrodes 314, 316 may be set at different potentials. Each one of the first and second fixed electrodes 314, 316 has its own separate electrical connections to respective contact pads 360, 364 (see grooves 314*a*, 316*a* that extend from the first and second fixed electrodes 314, 316). As illustrated in the subsequent figures, an ASIC or an electronic circuit may be coupled to the contact pads 360, 364.

Figure 10:
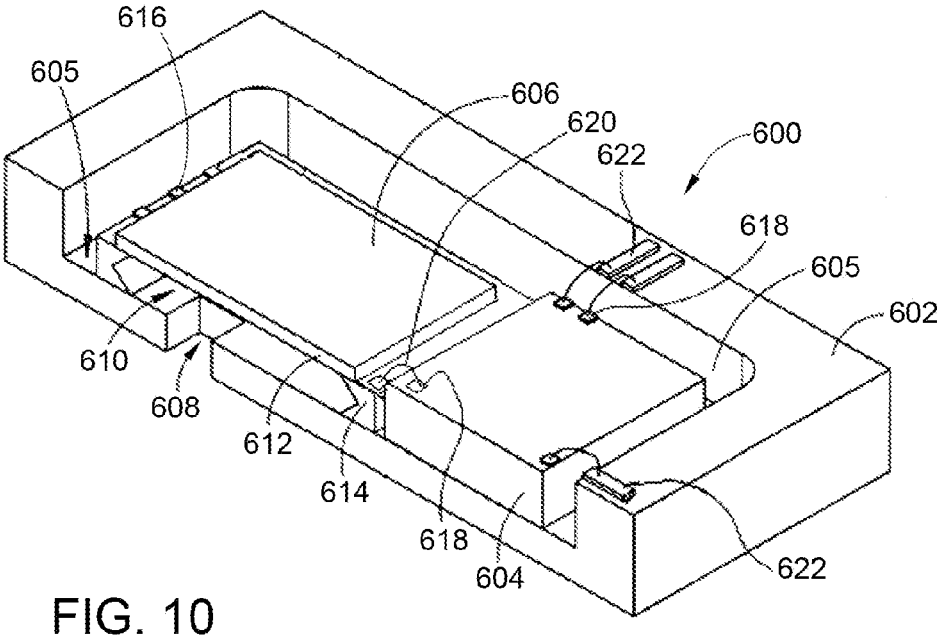
FIG. 10 is a schematic perspective view of a portion of a package.

FIG. 10 shows a package (here designated by 600), which includes an ASIC 604 and a MEMS die 606, which may form, for example, a microphone; consequently, the MEMS die 606 may be of the type illustrated in FIGS. 8 and 9 and thus include the vibrating membrane 312.

The package 600 includes a housing 602, which forms an internal chamber 605. Within the internal chamber 605, the ASIC 604 is adjacent to the MEMS die 606. The MEMS die 606 is aligned with an opening 608 formed in the housing 602. The opening 608 is configured to enable the sound waves to enter a rear chamber 610 of the MEMS die 606 so that the vibrating membrane (not illustrated) may detect the sound waves. The ASIC 604 is configured to contain the processing circuit 3 illustrated in FIG. 1.

The MEMS die 606 includes a protective membrane (here designated by 612), arranged on a substrate (here designated by 614). Numerous contact pads 616 are formed on the substrate 614, around the edges of the protective membrane 612. The ASIC 604 includes a plurality of respective contact pads 618, arranged on a top surface thereof. Some of the contact pads 616 are coupled to some of the contact pads 618 by wires 620. Other contact pads 622 may be formed on a top surface of the housing 602. Other contact pads 618 of the ASIC 604 are coupled to the contact pads 622 of the housing 602 and provide an electrical connection to external components, such as for example a PCB in a cellphone.

Figure 11:
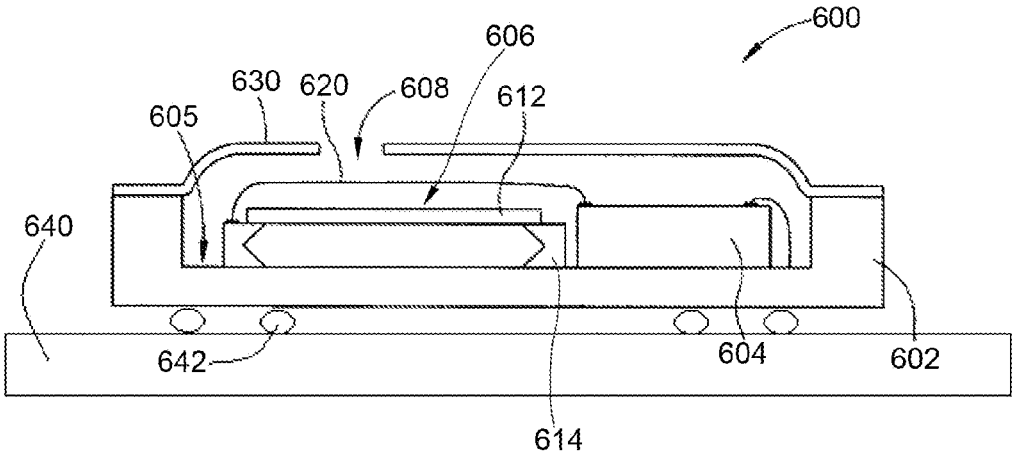
FIGS. 11-13 are schematic cross-sectional views of further packages.

In FIG. 11, the housing 602 is coupled to a PCB 640 through electrical connectors 642. In this embodiment, the housing 602 is solid, i.e., without openings. Further, the package 600 includes a cap 630 of a metal type, in which the opening 608 could alternately be formed, designed to enable entry of the sound waves into the package 600. The MEMS die 606 and the ASIC 604 are positioned on a bottom surface of the housing 602, within the internal chamber 605. The opening 608 in the cap 630 is positioned directly on the MEMS die 606. In this arrangement, the sound waves pass first through the protective membrane 612, for example through resonance holes or openings not illustrated in this view. The sound waves then strike the vibrating membrane and are detected by the capacitors. The cap 630 is coupled to a top surface of the housing 602, for sealing the package 600.

The MEMS die 606 is coupled to the ASIC 604 through a wire 620 that extends over a top part of the protective membrane 612. The wire 620 is arranged so as not to affect detection of the sound waves. For instance, the wire 620 may extend around an outer edge of the protective membrane 612.

The PCB 640 may be configured to house additional packages, containing for example additional processing circuits to be included in a mobile device. The additional packages may be coupled electrically to the package 600 through electrical connections in the PCB 640.

Figure 12:
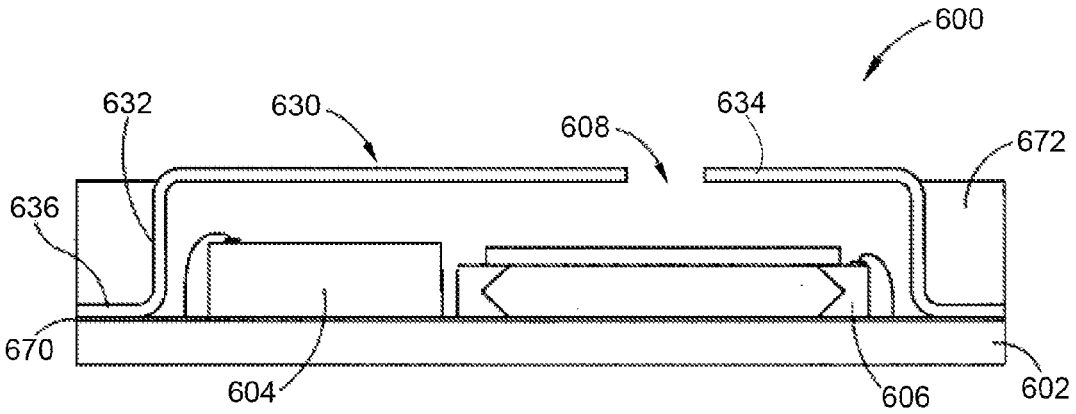

FIG. 12 is an alternative arrangement of the package 600, which includes a planar version of the housing 602, which does not form the walls of the internal chamber 605. An adhesion layer 670 is formed on the housing 602, prior to gluing of the ASIC 604 or of the MEMS die 606. The cap 630 has longer lateral portions 632 and is arranged on the planar housing, instead of on raised edges of the housing. Connection portions 636 adhere or are glued in some other way to the adhesion layer 670. The lateral portions 632 are covered by a package overmoulding 672 formed only around the lateral portions 632 themselves of the cap 630. This package overmoulding provides mechanical anchorages that reduce the likelihood of breaking of the seal of the package 600. A top portion 634 of the cap 630 remains exposed, and the opening 608 traverses this top portion.

Figure 13:
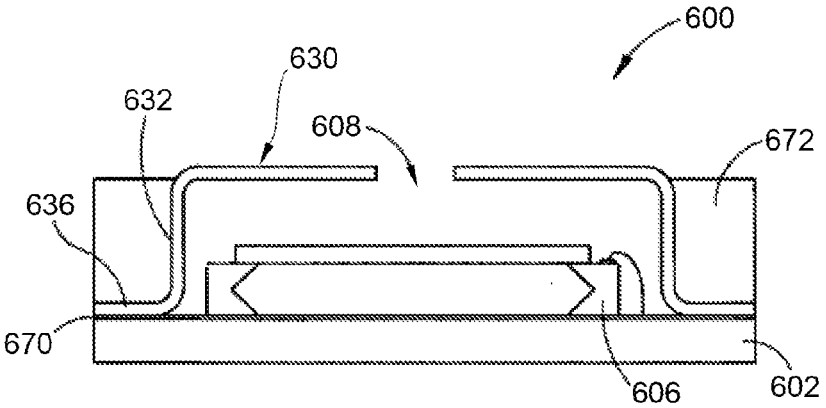

FIG. 13 is an alternative arrangement of the package 600, which includes only the MEMS die 606, arranged on the housing 602, which is of a planar type.

The package 600 illustrated in FIG. 13 has characteristics similar to the package illustrated in FIG. 12, except for the fact that it does not include the ASIC 604. In some embodiments, the MEMS die 606 is packaged by itself and the processing circuit 3 is included in a separate package, arranged at a distance from the MEMS die 606, on a PCB. The MEMS die 606 may include electrical connections, such as the electrical connectors 642 illustrated in FIG. 11, which are configured to transmit and receive signals to/from the processing circuit 3.

Irrespective of the details regarding the package, the MEMS die 606 may have an input pin, configured to receive a signal from the processing circuit, for selecting a normal channel, a high channel, or a combination of the normal channel and of the high channel. The normal channel may be the output of the main membrane, whereas the high channel may be the output of the peripheral membrane. The MEMS die 606 may likewise have an output pin, configured to output of the normal channel, of the high channel or of the combination of the normal channel and of the high channel, as a function of the signal received on the input pin.

The signal received on the input pin may be a selected sequence, which identifies in time which signal is supplied on the output pin. For instance, the normal channel may be supplied at output if the signal on the input pin is high and remains high for a selected period of time, the high channel may be supplied at output if the signal on the input pin is low and remains low for the period of time selected, and the combined signal may be supplied at output if the signal on the input pin alternates between a high value and a low value for the period of time selected. In addition, the signal received on the input pin for selecting the combined channel may be a sequence of high values and low values, which indicates the desired ratio between the normal channel and the high channel. For instance, if the signal received on the input pin is made up of eight bits and contains more "1s" than "0s", the output signal is based more upon the normal channel than upon the high channel. Instead, if the signal received on the input pin contains more "0s" than "1s", the output signal is based more upon the high channel than upon the normal channel. The specific ratio between normal channel and high channel may be set by selecting the number and order of the "1s" and "0s".

If the processing circuit is in a separate package, the selection signal, i.e., the signal present on the input pin, may be transferred onto the same input pin through an electrical connector and thus through the housing 602 as far as the MEMS die 606.

It is further possible for the MEMS die 606 to form one or more additional electronic circuits, designed to combine the high channel and the normal channel.

If the processing circuit is in the same package as the MEMS die 606, the selection signal may pass through the housing 602 as far as the MEMS die 606, or else through a wire arranged between the ASIC 604 and the MEMS die 606.

From what has been described and illustrated previously, the advantages that the present solution affords are evident.

In particular, the present processing circuit enables formation of a single stream of samples, based in each moment upon a signal coming from the sensing structure most suited to detecting the acoustic signal that impinges upon the microphone. In addition, the use of filters is limited to the processing stage 70, but for the first input filter 12 of the first sigma-delta converter 10; thus, it is limited to the portion of measurement of the sound-pressure level of the acoustic signal; consequently, as regards formation of the second PDM signal $s_{PDM2}(n)$, the integrity thereof is preserved, and further no delay is introduced.

In addition, the detection of zero-crossing is carried out in the analog domain, with consequent optimization of the reaction times. Once again, the adoption of a mechanism of comparison with two thresholds enables implementation of a sort of hysteresis; in fact, the comparator 80 is configured to vary the value of the comparison signal $s_{comp}(t)$ on the basis of the evolution in time of the modulus signal $s_{mod}(n)$ along a curve with hysteresis. In this way, occurrence of excessively frequent switchings between the first and second coefficients DIV1, DIV2 is prevented, with consequent reduction of the distortions.

In conclusion, it is clear that modifications and variations may be made to what has been described and illustrated herein.

For instance, the digital microphone 1 may comprise, in addition to the first and second sensing structures 2*a*, 2*b*, one or more additional sensing structures, each of which is associated to a corresponding coefficient, which may be used by the equalizer 30 for multiplying the samples of the first encoded signal $s_{code1}$ (n). In this case, the comparator 80 implements a scheme of comparison with more than two thresholds, for example with hysteresis. Consequently, the comparison signal $s_{comp}(t)$, as on the other hand also the control signal $s_c(n)$, may assume more than two values. As a result, the logic circuit 92 is a logic circuit designed to process signals with more than two levels and may include, amongst other things, a sample-and-hold and an analog-to-digital converter. In particular, assuming that the thresholds are in a number equal to N and comprise a minimum threshold and a maximum threshold, N+1 ranges of values are obtained, which include a bottom range, delimited at the top by the minimum threshold, a top range, delimited at the bottom by the maximum threshold, and a number greater than or equal to zero of intermediate ranges; this having been said, the comparator 80 operates so that:

- if the modulus signal $s_{mod}(n)$ has a value that falls within the bottom range, the comparison signal $s_{comp}(t)$ assumes a first extreme value;
- if the modulus signal $s_{mod}(n)$ has a value that falls within the top range, the comparison signal $s_{comp}(t)$ assumes a second extreme value; and
- if the modulus signal $s_{mod}(n)$ has a value that falls within one of the intermediate ranges, the comparison signal $s_{comp}(t)$ assumes alternatively a first or a second range value relating to the intermediate range in which the value of the modulus signal $s_{mod}(n)$ falls, according to whether the modulus signal $s_{mod}(n)$, before falling within this intermediate range, has fallen within a range arranged above or below this intermediate range.

Instead of the first and second sigma-delta converters 10, 40 converters of a different type may be present. For instance, the first sigma-delta converter 10 may be replaced by a multilevel analog-to-digital converter, or else by a sigma-delta converter including a quantizer having more than two quantization levels, and thus more than one threshold. In this case, the encoder 28 may be absent, and further, instead of the first PDM signal $s_{PDM1}(n)$, a stream of samples is generated, each of which is encoded on more than one bit.

In this connection, all the multibit signals generated by the processing circuit 3, such as for example the first and second encoded signals $s_{code1}(n)$, $s_{code2}(n)$, may be encoded in binary form with an encoding different from the one described. It is thus possible for the samples of the first and second encoded signals $s_{code1}(n)$, $s_{code2}(n)$ to be encoded with encodings different from the two's complement, such as for example a pure binary encoding, or else an unsigned encoding. It is likewise possible that at least part of the connections present between the blocks of the processing circuit 3 is of a type different from the one described; for example, in the digital domain, it is possible to adopt serial connections, instead of connections of a parallel type.

It is further possible for the waveform of the clock signal CLK(t) to be different from what has been described; for example, it is possible for the zero-detection circuit 90 to generate a rising edge of the clock signal CLK(t) whenever one between the first input signal $s_{in1}(t)$ and the second input signal $s_{in2}(t)$ crosses the zero and for it to generate a falling edge of the clock signal CLK(t) whenever the other between the first and second input signals $s_{in1}(t)$, $s_{in2}(t)$ crosses zero. Likewise, as mentioned previously, it is possible for the clock signal CLK(t) to indicate the zero-crossings of just one between the first and second input signals $s_{in1}(t)$, $s_{in2}(t)$. Once again, the clock signal CLK(t) may have rising edges that are not substantially concomitant with the instants of zero-crossing of the first and second input signals $s_{in1}(t)$, $s_{in2}(t)$; for example, for each pair of corresponding zeros (i.e., ones originating from the same instantaneous value of the acoustic signal and offset in time on account of the different delays introduced by the first and second sensing structures 2*a*, 2*b*, as well as by the first and second amplification stages 6*a*, 6*b*) of the first and second input signals $s_{in1}(t)$, $s_{in2}(t)$, it is possible for the clock signal CLK(t) to have a rising edge that falls between the instants of this pair of corresponding zeros.

Likewise possible are embodiments in which the zero-detection circuit 90 is implemented so that, in the case where, during a time interval of predetermined duration, there is no zero-crossing by either the first input signal $s_{in1}(t)$ or the second input signal $s_{in2}(t)$, it generates in any case a pulse of the clock signal CLK(t). In this way, the control signal $s_c(n)$ is updated also in the case where, for example, the acoustic signal ceases completely, but, on account of the presence of offset, following upon cessation of the acoustic signal there is in any case no zero-crossing by either the first input signal $s_{in1}(t)$ or the second input signal $s_{in2}(t)$; in this way, for practical purposes a sort of reset of the processing circuit 3 is obtained.

As regards operation of the logic circuit 92, the instants of (possible) switching of the output may be determined in a way different from what has been described; for example, these instants may coincide with the instants in which the falling edges of the clock signal CLK(t) occur.

As regards the second sigma-delta converter 40, it may be absent, in which case the processing circuit 3 supplies at output a multibit signal.

Once again, it is possible for the first and second amplification stages 6*a*, 6*b* to be absent, and thus that $G_1=G_2=1$. In other words, the first and second input signals $s_{in1}(t)$, $s_{in2}(t)$ may be, respectively, equal to the first and second detection signals $s_{d1}(t)$, $s_{d2}(t)$.

Finally, even though in the present description, in order to indicate the operation performed by the equalizer 30, reference has been made to the division, this operation may likewise be a multiplication by a factor alternatively equal to the first coefficient DIV1 or else the second coefficient DIV2; in this connection, is further possible for one or both of the first and second coefficients DIV1, DIV2 to be greater than unity.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A processing circuit for a digital sensor, comprising:

a control stage configured to generate a control signal;

a multiplexing stage configured to receive corresponding detection signals from a plurality of external signal sensing structures, said multiplexing stage being configured to generate a multiplexed signal, on the basis of one of said detection signals, as a function of the control signal;

an analog-to-digital conversion stage, coupled to the multiplexing stage and configured to generate a first encoded signal, on the basis of the multiplexed signal; and an equalizer, configured to multiply the first encoded signal by a coefficient that depends upon the control signal, the equalizer is configured to output a second encoded signal, and the control stage is configured to generate the control signal as a function of the second encoded signal, and wherein the control stage includes:

a filtering stage configured to generate a filtered signal, as a function of the second encoded signal;

a demodulation stage, coupled to the filtering stage and configured to generate a measurement signal as a function of the filtered signal;

a comparator coupled to the demodulation stage and configured to generate a comparison signal; and an output stage configured to generate the control signal, as a function of the comparison signal.

2. The circuit according to claim 1 wherein the filtering stage comprises at least one numeric low-pass filter and a numeric high-pass filter.

3. The circuit according to claim 1 wherein the comparator is configured to vary the comparison signal as a function of an evolution in time of the measurement signal along a curve with hysteresis.

4. The circuit according to claim 1 wherein the output stage comprises:

a synchronism stage configured to generate a synchronism signal indicating instants of crossing of reference values by one or more of the detection signals; and a synchronous circuit coupled to the comparator and to the synchronism stage and configured to generate the control signal as a function of the comparison signal and the synchronism signal;

and wherein the multiplexing stage is configured to vary the detection signals, at instants that depend upon said instants of crossing of reference values; and wherein the equalizer is configured to vary said coefficient at the same instants in which the multiplexing stage varies the detection signals.

5. The circuit according to claim 4 wherein the synchronism stage is configured so that the synchronism signal indicates the instants of zero-crossing by said one or more of the detection signals.

6. The circuit according to claim 4 wherein the synchronous circuit is configured so that the control signal is a function of values assumed by the comparison signal in said instants of crossing of reference values by said one or more of the detection signals.

7. The circuit according to claim 1 wherein the analog-to-digital conversion stage comprises an input sigma-delta converter, coupled to the multiplexing stage and configured to generate a first PDM signal.

8. The circuit according to claim 7 wherein the first PDM signal encodes a first stream of samples with a single-bit binary encoding; and wherein the analog-to-digital conversion stage comprises a binary encoder, coupled to the input sigma-delta converter.

9. The circuit according to claim 8 wherein the second encoded signal is formed by a second stream of samples, said circuit further comprising an output sigma-delta converter, of a digital-to-digital type, coupled to the equalizer and configured to generate a second PDM signal.

10. The circuit according to claim 1 wherein the equalizer is configured to select said coefficient from among a plurality of coefficients, as a function of the control signal.

11. A device, comprising:

a package;

a sensor formed in the package, the sensor includes:

a first die;

a second die;

a plurality of sensing structures formed on the first die, each configured to output a detection signal; and a processing circuit formed on the second die, the processing circuit includes:

a control stage configured to generate a control signal;

a multiplexing stage configured to receive the detection signals from the plurality of sensing structures, the multiplexing stage being configured to generate a multiplexed signal, on the basis of one of the detection signals, as a function of the control signal;

an analog-to-digital conversion stage, coupled to the multiplexing stage and configured to generate a first encoded signal, on the basis of the multiplexed signal; and an equalizer, configured to multiply the first encoded signal by one of a plurality of coefficients, the one of the plurality of coefficients depending upon the control signal, the equalizer is configured to output a second encoded signal, and the control stage is configured to generate the control signal as a function of the second encoded signal, and wherein the control stage includes:

a filtering stage configured to generate a filtered signal, as a function of the second encoded signal;

a demodulation stage, coupled to the filtering stage and configured to generate a measurement signal as a function of the filtered signal;

a comparator coupled to the demodulation stage and configured to generate a comparison signal; and an output stage configured to generate the control signal, as a function of the comparison signal.

12. The device according to claim 11 wherein the plurality of sensing structures have different sensitivities, and wherein each coefficient of said plurality of coefficients is a function of the sensitivity of a corresponding sensing structure; and wherein the equalizer is such that, when the multiplexed signal is generated on the basis of one of the detection signals coming from a first sensing structure of the plurality of sensing structures, the first encoded signal is multiplied by one of the coefficients that corresponds to said first sensing structure.

13. The device according to claim 12 wherein the coefficients of said plurality of coefficients are such that products of one of the coefficients by one of the sensitivities of the corresponding sensing structures are substantially equal to the same value.

14. The device according to claim 12 wherein the multiplexing stage comprises:

a plurality of amplification stages, electrically coupled to corresponding sensing structures, each amplification stage being configured to generate a respective input signal on the basis of the corresponding detection signal and of a respective gain; and a multiplexer configured to generate the multiplexed signal, on the basis of one of said input signals, as a function of the control signal, and wherein the coefficients of said plurality of coefficients are such that products of one of the coefficients by one of the sensitivities of the corresponding sensing structures and by one of the gains of the corresponding amplification stages are substantially equal to the same value.

15. The device according to claim 11 wherein the sensor is a microphone.

16. The device according to claim 11 wherein the sensing structures are formed in a first die and the processing circuit is formed in a second die.

17. An electronic system, comprising:

a processing unit;

a speaker, coupled to the processing unit; and a sensor package that includes:

a first die;

a plurality of sensing structures formed on the first die and each configured to output a detection signal; and a second die;

a processing circuit formed on the second die and coupled to the processing unit, the processing circuit including:

a control stage configured to generate a control signal;

a multiplexing stage configured to receive the detection signals from the plurality of sensing structures, the multiplexing stage being configured to generate a multiplexed signal, on the basis of one of the detection signals, as a function of the control signal;

an analog-to-digital conversion stage, coupled to the multiplexing stage and configured to generate a first encoded signal, on the basis of the multiplexed signal; and an equalizer, configured to multiply the first encoded signal by one of a plurality of coefficients, the one of the plurality of coefficients depending upon the control signal, the equalizer is configured to output a second encoded signal, and the control stage is configured to generate the control signal as a function of the second encoded signal, and wherein the control stage includes:

a filtering stage configured to generate a filtered signal, as a function of the second encoded signal;

a demodulation stage, coupled to the filtering stage and configured to generate a measurement signal as a function of the filtered signal;

a comparator coupled to the demodulation stage and configured to generate a comparison signal; and an output stage configured to generate the control signal, as a function of the comparison signal.

18. The system of claim 17 wherein the plurality of sensing structures have different sensitivities, and each coefficient of said plurality of coefficients is a function of the sensitivity of a corresponding sensing structure; and the equalizer is such that, when the multiplexed signal is generated on the basis of one of the detection signals coming from a first sensing structure of the plurality of sensing structures, the first encoded signal is multiplied by one of the coefficients that corresponds to said first sensing structure.

* * * * *